US009188399B1

(12) United States Patent
Findlay et al.

(10) Patent No.: US 9,188,399 B1
(45) Date of Patent: Nov. 17, 2015

(54) RECEIVER CATCH

(71) Applicant: Smith & Wesson Corp., Springfield, MA (US)

(72) Inventors: David S. Findlay, Athol, MA (US); David Jonathan Findlay, Athol, MA (US)

(73) Assignee: Smith & Wesson Corp., Springfield, MA (US)

( * ) Notice: Subject to any disclaimer, the term of this patent is extended or adjusted under 35 U.S.C. 154(b) by 0 days.

(21) Appl. No.: 14/529,554

(22) Filed: Oct. 31, 2014

(51) Int. Cl.
*F41A 3/66* (2006.01)
*F41A 3/04* (2006.01)
*F41A 11/02* (2006.01)

(52) U.S. Cl.
CPC ... *F41A 3/04* (2013.01); *F41A 3/66* (2013.01); *F41A 11/02* (2013.01)

(58) Field of Classification Search
CPC ..... F41C 7/11; F41A 11/02; F41A 3/66; F41A 3/04
USPC ..... 42/75.01–75.03
See application file for complete search history.

(56) References Cited

U.S. PATENT DOCUMENTS

| | | | | |
|---|---|---|---|---|
| 187,462 | A | 2/1877 | Eutebrouk | |
| 728,326 | A | 5/1903 | Sturgill | |
| 1,588,887 | A | 6/1926 | Haubroe | |
| 1,852,440 | A * | 4/1932 | Swebilius | 42/75.03 |
| 2,302,059 | A * | 11/1942 | Roemer | 42/16 |
| 6,363,831 | B2 | 4/2002 | Gussalli Beretta | |
| 7,131,228 | B2 | 11/2006 | Hochstrate et al. | |
| 7,392,611 | B2 | 7/2008 | Curry | |
| 7,753,679 | B1 | 7/2010 | Schuetz | |
| 7,810,271 | B2 | 10/2010 | Patel | |
| 7,941,954 | B2 | 5/2011 | Carr et al. | |
| 8,051,595 | B2 | 11/2011 | Hochstrate et al. | |
| 8,261,479 | B2 | 9/2012 | Barrett | |

* cited by examiner

*Primary Examiner* — Reginald Tillman, Jr.
(74) *Attorney, Agent, or Firm* — John A. Chionchio; Ballard Spahr LLP

(57) ABSTRACT

A catch is used to secure upper and lower receiver portions of a modern sporting rifle to one another. The catch may be mounted in either receiver portion and includes a shaft on which a body is mounted. The body has a hook and a cam follower positioned on opposite sides of the shaft. The cam follower engages a cam surface, which rotates the hook into engagement with a contact surface to secure the receiver portions to one another when they are pivoted into a closed configuration.

27 Claims, 4 Drawing Sheets

FIG. 1
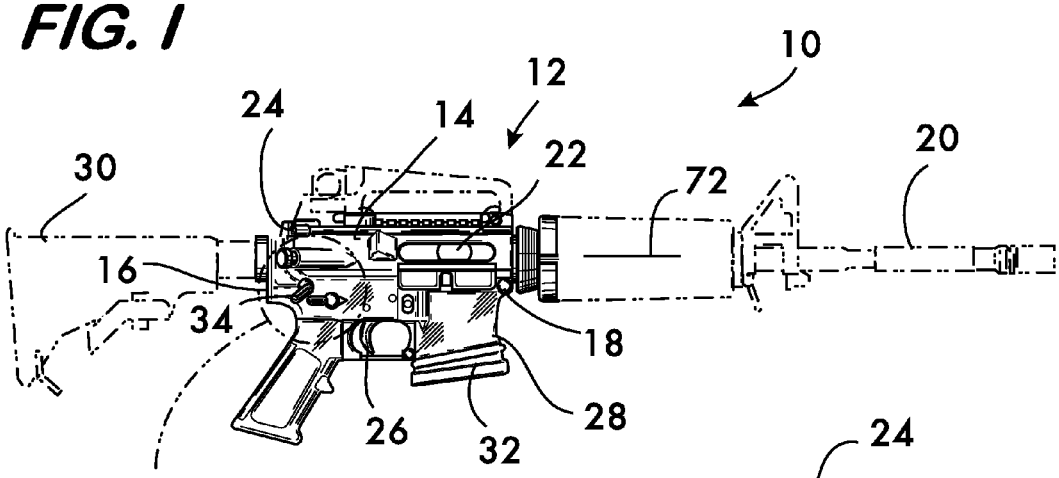
FIG. 3
FIG. 2
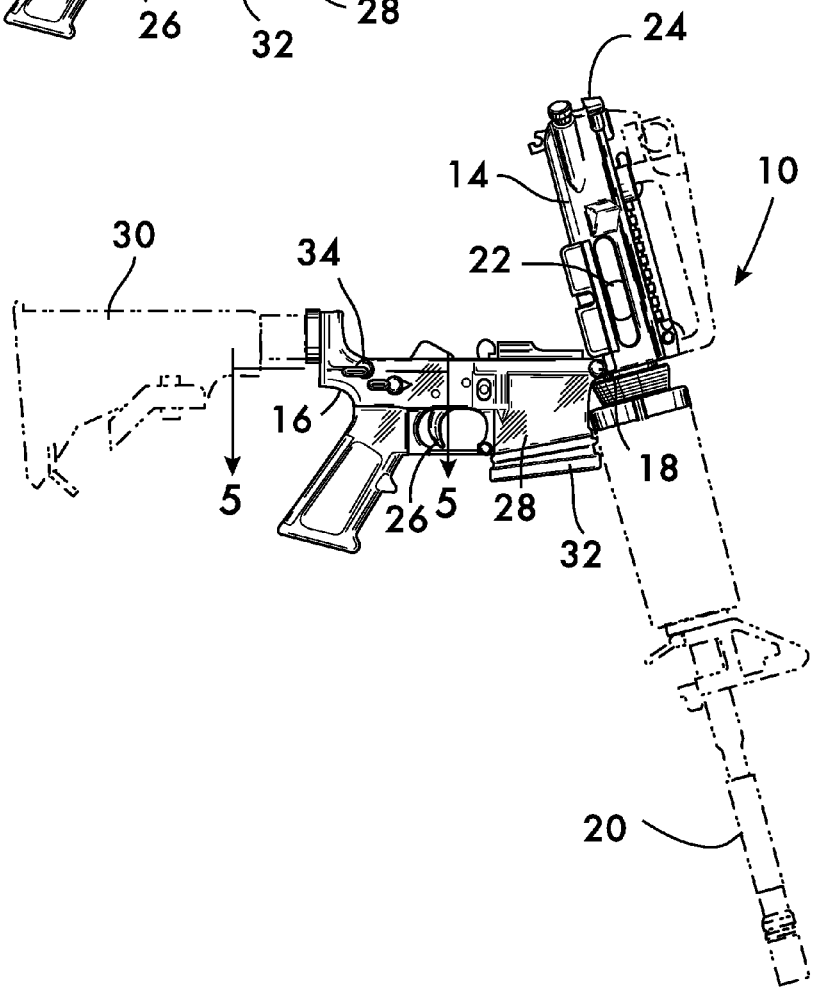

RECEIVER CATCH

FIELD OF THE INVENTION

This invention relates to firearms having receivers formed of upper and lower receiver portions, and mechanisms for releaseably retaining the upper and lower receiver portions to one another.

BACKGROUND

The receiver of many modern sporting rifles comprises an upper receiver portion and a lower receiver portion. The upper receiver portion houses, among other components, the barrel, the bolt carrier and the charging handle. The lower receiver portion includes the firing mechanism the magazine and the rifle stock. Many rifle designs use two pins, a forward pin (positioned near the barrel breech) and a rear pin (positioned near the rifle stock), which engage the upper and lower receiver portions and hold them together. In a popular rifle design the forward pin is mounted in a pivot bearing, which permits the upper and lower receiver portions to pivot relatively to one another between an open and a closed configuration. In this design the rear pin may be mounted on the lower receiver portion and engage a catch mounted within the upper receiver portion. The rear pin is designed to be removed from the lower receiver portion or otherwise displaced from engagement with the catch to permit the upper and lower receiver portions to pivot relatively to one another about the forward pin.

The many advantages of the pivotable upper and lower receiver designs include ease of cleaning the rifle, ease of repair, and access to the magazine, which is especially useful for reloading if the magazine is fixed in the lower receiver and the only access to it is when the upper and lower receiver portions are in the open configuration. These advantages, however, are not uniformly realized because it is often difficult to remove or displace the rear pin to disengage it from its catch and free the upper and lower receiver portions from one another. The difficulty may arise, for example, because of binding between the rear pin and the lower and upper receiver portions. Tolerances and misalignments vary the force required between different rifles to overcome this binding; some rear pins require a tool to displace them into and out of engagement. There is clearly an opportunity to improve the design of modern sporting rifles and better realize the advantages of pivotably attached upper and lower receiver portions.

SUMMARY

The invention concerns a catch for releasably retaining an upper receiver portion of a firearm to a lower receiver portion thereof. In one example embodiment the catch comprises a shaft rotatably mountable within one of the upper and lower receiver portions. A lever extends transversely from the shaft for manual rotation thereof. A body is mounted on the shaft and rotatable therewith. A hook is positioned on the body, the hook being engageable with an other of the upper and lower receiver portions for retaining the upper and lower receiver portions to one another.

In a particular example embodiment, the catch further comprises a cam follower projecting from the body. The shaft is between the cam follower and the hook. The cam follower is engageable with the other of the upper and lower receiver portions for rotating the hook into engagement with the other of the upper and lower receiver portions.

In an example embodiment the body and the shaft are separate parts from one another. In another example the body has a non-round opening extending therethrough and the shaft has a non-round portion matched in shape to the non-round opening of the body. The non-round portion is received within the non-round opening. In a particular example, the non-round portion has a square cross section.

By way of example the catch further comprising a retaining nut receiving the shaft. The retaining nut has a shoulder projecting outwardly therefrom. In this embodiment the shaft comprises a threaded portion having external screw threads thereon, and the retaining nut has internal screw threads matched to the external screw threads of the shaft. The nut receives the threaded portion of the shaft.

The invention also encompasses an example firearm having an upper and a lower receiver portion joined to one another by a pivot bearing. In this firearm the receiver portions are movable on the pivot bearing between an open and a closed configuration. A catch for releasably retaining the upper receiver portion to the lower receiver portion comprises a shaft rotatably mounted within one of the upper and lower receiver portions. A lever extends transversely from the shaft for manual rotation thereof. The lever overlies an outer surface of the one of the upper and lower receiver portions. A body is mounted on the shaft and rotatable therewith. The body is positioned within the one of the upper and lower receiver portions. A hook is positioned on the body. A contact surface is positioned on an other of the upper and lower receiver portions. The hook is engageable with the contact surface for retaining the upper and lower receiver portions to one another.

By way of example the firearm further comprises a cam follower projecting from the body. The shaft is positioned between the cam follower and the hook. A cam surface is mounted on the other of the upper and lower receiver portions and positioned so as to engage the cam follower when the receiver portions are moved into the closed configuration so as to rotate the body such that the hook engages the contact surface and retains the other of the upper and lower receiver portions to the one of the upper and lower receiver portions. In a particular example embodiment the body and the shaft are separate parts from one another. By way of further example, the body has a non-round opening extending therethrough, and the shaft has a non-round portion matched in shape to the non-round opening of the body. The non-round portion is received within the non-round opening. In a specific example, the non-round portion of the shaft has a square cross section.

Additionally by way of example the firearm further comprises a retaining nut receiving the shaft. The retaining nut is received within an opening in the one of the upper and lower receiver portions. The retaining nut has a shoulder projecting outwardly therefrom. The shoulder engages an inner surface of the one of the upper and lower receiver portions. In an example embodiment the shaft comprises a threaded portion having external screw threads thereon, and the retaining nut has internal screw threads matched to the external screw threads of the shaft. The nut receives the threaded portion of the shaft.

In an example embodiment the shaft is positioned distally to the pivot bearing. In a further example the contact surface is angularly oriented relative to a firing axis of the firearm. In a specific example embodiment a counter surface is positioned on the other of the upper and lower receiver portions and contiguous with the contact surface. The counter surface is angularly oriented with respect to the contact surface and provides clearance between the hook and the other of the upper and lower receiver portions for rotation of the body which disengages the hook from the contact surface.

The invention further encompasses a firearm having an upper and a lower receiver portion joined to one another by a pivot bearing. In this example firearm the receiver portions are movable on the pivot bearing relatively to one another between an open and a closed configuration. A catch is included for releasably retaining the upper receiver portion to the lower receiver portion. In a particular example the catch comprises a shaft rotatably mounted within the lower receiver portion. A lever extends transversely from the shaft for manual rotation thereof. The lever overlies an outer surface of the lower receiver portion. A body is mounted on the shaft and is rotatable therewith. The body is positioned within the lower receiver portion. A hook is positioned on the body. A contact surface is positioned on the upper receiver portion. The hook is engageable with the contact surface for retaining the upper and lower receiver portions to one another.

A specific example fireare further comprises a cam follower projecting from the body. The shaft is positioned between the cam follower and the hook. A cam surface is mounted on the upper receiver portion and is positioned so as to engage the cam follower when the receiver portions are moved into the closed configuration so as to rotate the body such that the hook engages the contact surface and retains the upper receiver portion to the lower receiver portion. By way of example the body and the shaft are separate parts from one another. Additionally by way of example the body has a non-round opening extending therethrough, and the shaft has a non-round portion matched in shape to the non-round opening of the body, the non-round portion being received within the non-round opening. Specifically by way of example the non-round portion of the shaft has a square cross section.

Additionally by way of example the firearm comprises a retaining nut receiving the shaft. The retaining nut is received within an opening in the lower receiver. The retaining nut has a shoulder projecting outwardly therefrom, the shoulder engaging an inner surface of the lower receiver portion. In a further example the shaft comprises a threaded portion having external screw threads thereon. The retaining nut has internal screw threads matched to the external screw threads of the shaft, the nut receiving the threaded portion of the shaft. In a specific example the shaft is positioned distally to the pivot bearing.

In another example the contact surface is angularly oriented relative to a firing axis of the firearm. In an example the firearm further comprises a counter surface on the upper receiver portion and contiguous with the contact surface. The counter surface is angularly oriented with respect to the contact surface and provides clearance between the hook and the upper receiver portion for rotation of the body disengaging the hook from the contact surface.

BRIEF DESCRIPTION OF THE DRAWINGS

FIG. 1 is a right side view of an example modern sporting rifle using a catch according to the invention, the receiver being shown in a closed configuration;

FIG. 2 is a right side view of the rifle shown in FIG. 1 but with the receiver in an open configuration;

DETAILED DESCRIPTION

Figure 3:
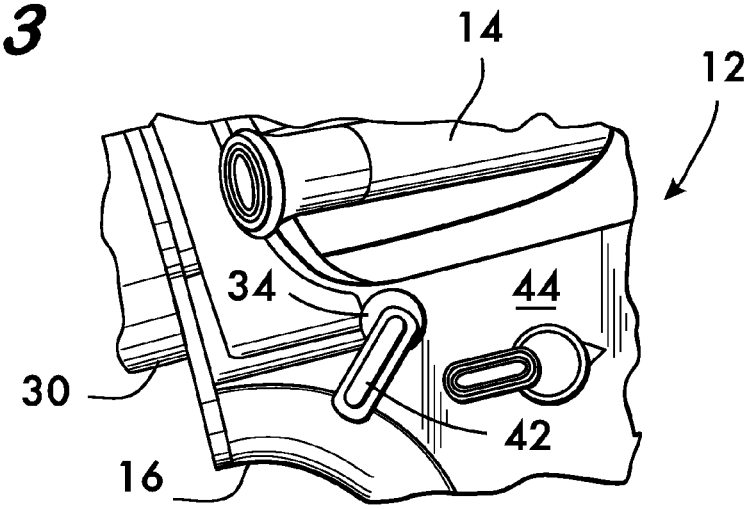
FIG. 3 is a plan view of a portion of the right side of the rifle shown circled in FIG. 1 and on an enlarged scale.

FIG. 1 shows a firearm, in this example a modern sporting rifle 10 having a receiver 12 comprising an upper receiver portion 14 and a lower receiver portion 16. Upper and lower receiver portions 14 and 16 are joined to one another at a pivot bearing 18, which permits the receiver portions to pivot relatively to one another between a closed configuration, shown in FIG. 1, and an open configuration, shown in FIG. 2. As also shown in FIG. 2, the rifle 10 includes a barrel 20, bolt carrier 22 and charging handle 24 mounted on the upper receiver portion 14. The firing mechanism (represented by trigger 26), the magazine well 28 and the rifle stock 30 are part of the lower receiver portion 16. Note that an ammunition magazine 32 is received within the magazine well. The ammunition magazine may be removable or fixed.

Figure 4:
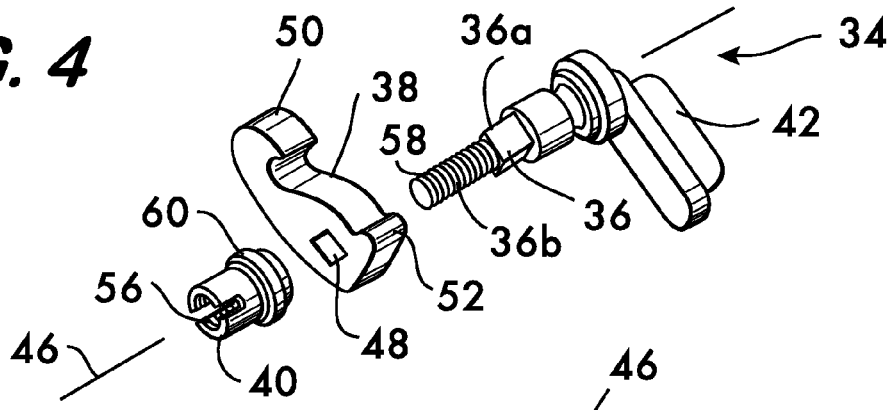
FIG. 4 is an exploded isometric view of an example embodiment of a catch according to the invention.

In the example rifle 10 the pivot bearing 18 is positioned forward of the magazine well and, as shown in FIGS. 2 and 3, a catch 34 is positioned at the opposite end of the receiver 12 forward of the rifle stock 30. FIG. 4 shows an exploded isometric view of the catch 34 including a shaft 36, a body 38 and a retaining nut 40. A lever 42 extends transversely to the shaft 36. As shown in FIG. 3, the lever 42 overlies an outer surface 44 of receiver 12 (in this example the outer surface of the lower receiver portion 16) to permit manual manipulation of the catch 34 as described below. Body 38 is a separate part mounted on the shaft 36. In use, the shaft 36 and body 38 turn together about the shaft axis 46 when force is applied to the lever 42. This is ensured because body 38 has a non-round opening 48 extending therethrough, the opening 48 receiving a non-round portion 36*a* of shaft 36, engagement between the non-round opening and non-round shaft portion preventing relative rotation between the body 38 and the shaft 36. In this example, both the opening 48 and the shaft portion 36*a* have square cross sectional shapes, but other non-round shapes that prevent relative rotation are of course feasible. It is also conceivable that the body 38 and shaft 36 could be integrally formed with one another as a single piece.

A hook 50 is positioned on the body 38, in this example in spaced relation to the shaft 36. A cam follower 52 projects from body 38. Cam follower 52 has a rounded engagement surface 54. The shaft 36 is positioned between the hook 50 and the cam follower 52.

Retaining nut 40 has internal screw threads 56, which receive a portion 36*b* of shaft 36 having external screw threads 58. Retaining nut 40 also has an outwardly projecting shoulder 60. In this example shoulder 60 comprises an annular surface extending circumferentially around retaining nut 40.

Figure 5:
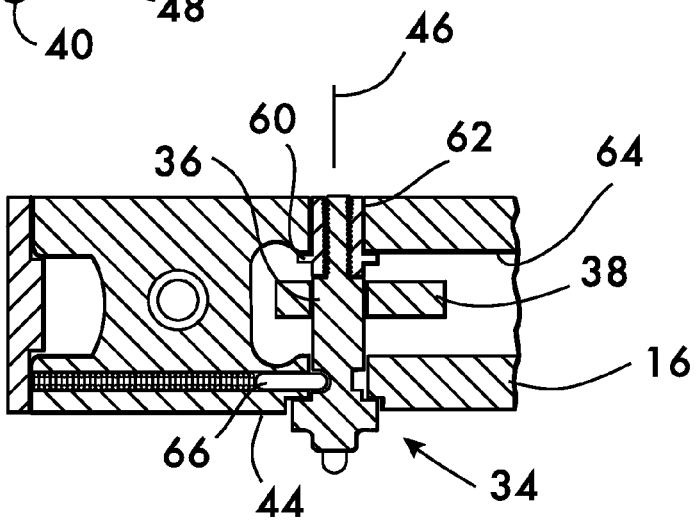
FIG. 5 is a plan partial sectional view of the lower receiver of the rifle taken at line 5-5 of FIG. 2.

FIG. 5 shows the catch 34 in sectional view and assembled within the lower receiver portion 16 of the rifle 10, the shaft 32 positioned distally to the pivot bearing 18 (see also FIGS. 1 and 2). Retaining nut 40 is received within an opening 62 of the lower receiver portion 16 and shoulder 60 engages an inner surface 64 thereof. Engagement between the shoulder 60 and the inner surface 62 prevents the retaining nut 40 from loosening and "walking out" of the opening 62 when subjected to use and vibration. It is also found advantageous to engage the shaft 36 with a spring biased detent 66 to lock the catch 34 securely within the lower receiver portion 16 while still permitting relative rotation between it and the shaft 36.

Figure 6:
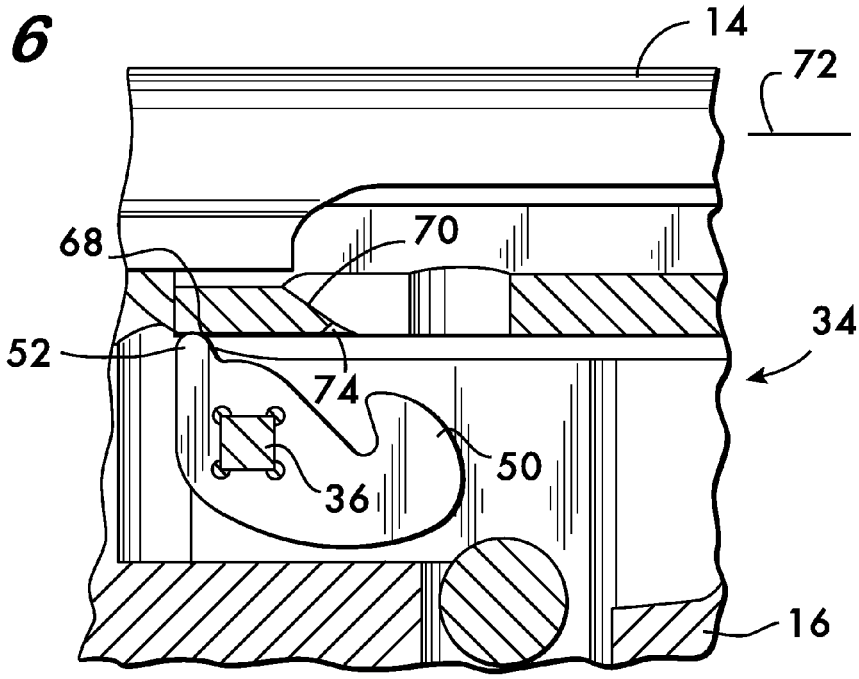
FIGS. 6-8 are partial sectional views illustrating operation of the catch embodiment shown in FIGS. 4 and 5.
Figure 7:
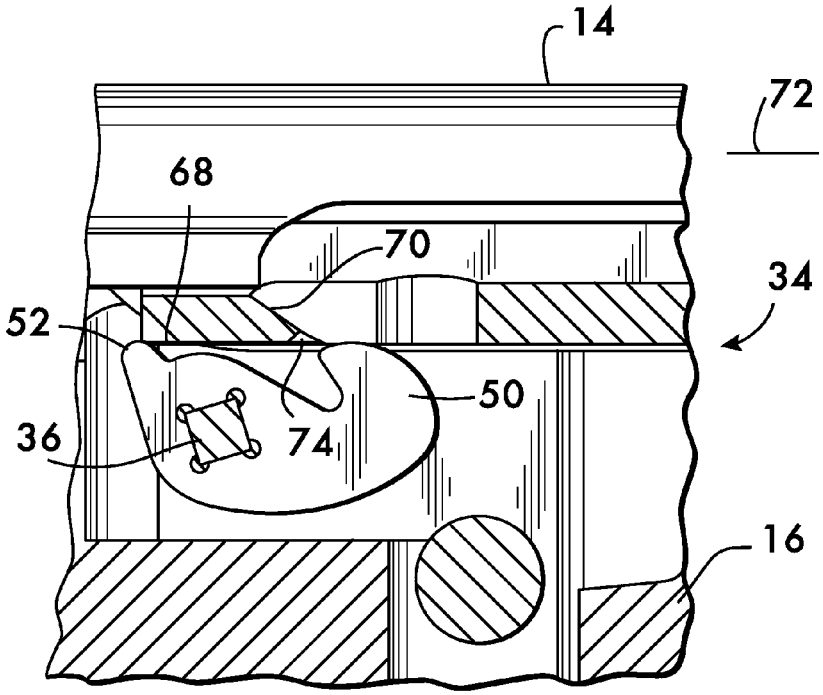
Figure 8:
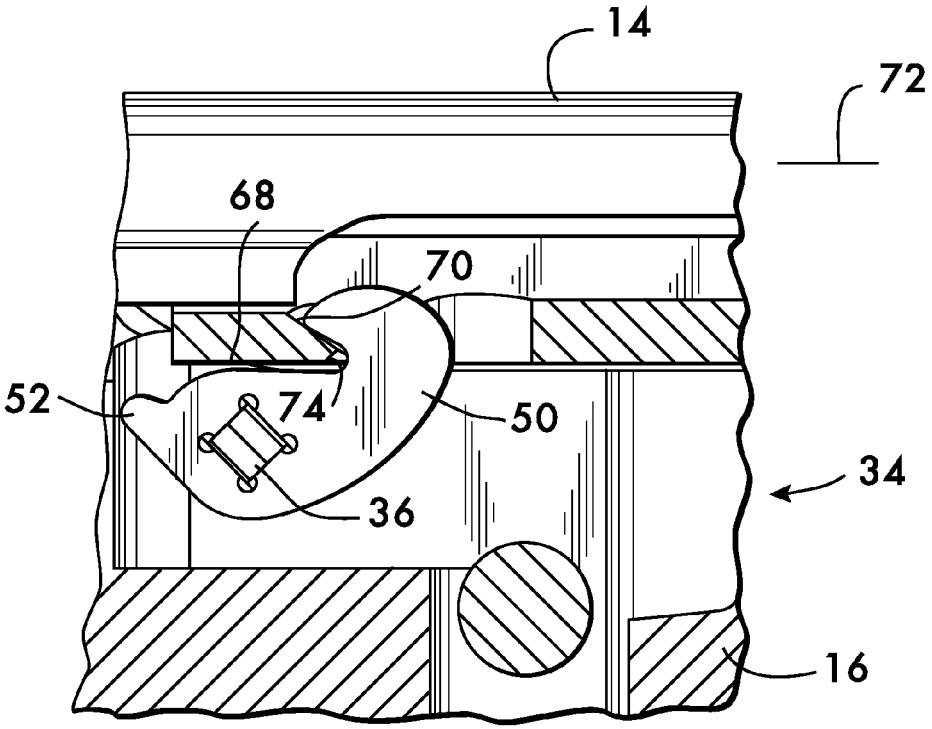

FIGS. 6-8 illustrate operation of the catch 34 with the modern sporting rifle 10. As shown in FIG. 6, upper receiver portion 14 is pivoted relative to lower receiver portion 16 from the open configuration of FIG. 2 to the closed configuration of FIG. 1. Shaft 36 is shown rotationally positioned to: 1) present cam follower 52 to a cam surface 68 mounted on the upper receiver portion 14; and 2) position hook 50 so that it does not interfere with the upper receiver portion 14 as it pivots toward the lower receiver portion 16. FIG. 7 shows the catch 34 as the cam surface 68 engages the cam follower 52 and rotates the shaft 36 to the point just before the hook 50 engages the upper receiver portion 14. As shown by comparison of FIGS. 7 and 8, the upper and lower receiver portions 14 and 16 are secured to one another when hook 50 engages a contact surface 70 positioned on the upper receiver portion 14. It is advantageous to angularly orient contact surface 70 relatively to the firing axis 72 of rifle 10 (see also FIG. 1) to receive the hook 50 in positive mechanical engagement. It is also advantageous to include a counter surface 74 on the upper receiver portion 14. As shown in FIG. 7, the counter surface 74 is contiguous with contact surface 70 and oriented angularly with respect to it to provide clearance between the hook 50 and the upper receiver portion 14 as the hook moves into and out of engagement with the contact surface 70 upon rotation of shaft 36.

Catch 34 is designed to be self-actuating into the closed and locked position (FIG. 8) when the receiver portions 14 and 16 are pivoted "smartly" into engagement with one another (i.e., there is no need to manually rotate the shaft 36 using lever 42 to engage the hook 50 with the contact surface 70). Catch 34 is further designed so that the cam follower 52 provides an impulse to the cam surface 68 to assist separation of the upper and lower receiver portions when the lever 42 is rotated to disengage the hook 50 from the contact surface 70 to open the receiver 12 for cleaning or loading of a fixed magazine for example. While the catch 34 is shown mounted in the lower receiver portion 16, it is understood that this is by way of example only and that it is also feasible to mount the catch in the upper receiver.

What is claimed is:

1. A catch for releasably retaining an upper receiver portion of a firearm to a lower receiver portion thereof, said catch comprising:

a shaft rotatably mountable within one of said upper and lower receiver portions;

a lever extending transversely from said shaft for manual rotation thereof;

a body mounted on said shaft and rotatable therewith;

a hook positioned on said body, said hook being engageable in positive mechanical engagement with an other of said upper and lower receiver portions for retaining said upper and lower receiver portions to one another.

2. The catch according to claim 1, further comprising a cam follower projecting from said body, said shaft being between said cam follower and said hook, said cam follower being engageable with said other of said upper and lower receiver portions for rotating said hook into engagement with said other of said upper and lower receiver portions.

3. The catch according to claim 1, wherein said body and said shaft are separate parts from one another.

4. The catch according to claim 3, wherein:

said body has a non-round opening extending therethrough;

said shaft has a non-round portion matched in shape to said non-round opening of said body, said non-round portion being received within said non-round opening.

5. The catch according to claim 4, wherein said non-round portion has a square cross section.

6. The catch according to claim 1, further comprising a retaining nut receiving said shaft, said retaining nut having a shoulder projecting outwardly therefrom.

7. The catch according to claim 6, wherein:

said shaft comprises a threaded portion having external screw threads thereon;

said retaining nut has internal screw threads matched to said external screw threads of said shaft, said nut receiving said threaded portion of said shaft.

8. A firearm having an upper and a lower receiver portion joined to one another by a pivot bearing, said receiver portions being movable on said pivot bearing between an open and a closed configuration, a catch for releasably retaining said upper receiver portion to said lower receiver portion, said catch comprising:

a shaft rotatably mounted within one of said upper and lower receiver portions;

a lever extending transversely from said shaft for manual rotation thereof, said lever overlying an outer surface of said one of said upper and lower receiver portions;

a body mounted on said shaft and rotatable therewith, said body being positioned within said one of said upper and lower receiver portions;

a hook positioned on said body;

a contact surface positioned on an other of said upper and lower receiver portions, said hook being engageable in positive mechanical engagement with said contact surface for retaining said upper and lower receiver portions to one another.

9. The firearm according to claim 8, further comprising:

a cam follower projecting from said body, said shaft being positioned between said cam follower and said hook;

a cam surface mounted on said other of said upper and lower receiver portions and positioned so as to engage said cam follower when said receiver portions are moved into said closed configuration so as to rotate said body such that said hook engages said contact surface and retains said other of said upper and lower receiver portions to said one of said upper and lower receiver portions.

10. The firearm according to claim 8, wherein said body and said shaft are separate parts from one another.

11. The firearm according to claim 10, wherein:

said body has a non-round opening extending therethrough;

said shaft has a non-round portion matched in shape to said non-round opening of said body, said non-round portion being received within said non-round opening.

12. The firearm according to claim 11, wherein said non-round portion of said shaft has a square cross section.

13. The firearm according to claim 8, further comprising a retaining nut receiving said shaft, said retaining nut being received within an opening in said one of said upper and lower receiver portions, said retaining nut having a shoulder projecting outwardly therefrom, said shoulder engaging an inner surface of said one of said upper and lower receiver portions.

14. The firearm according to claim 13, wherein:

said shaft comprises a threaded portion having external screw threads thereon;

said retaining nut has internal screw threads matched to said external screw threads of said shaft, said nut receiving said threaded portion of said shaft.

15. The firearm according to claim 8, wherein said shaft is positioned distally to said pivot bearing.

16. The firearm according to claim 8, wherein said contact surface is angularly oriented relative to a firing axis of said firearm.

17. The firearm according to claim 16, further comprising a counter surface on said other of said upper and lower receiver portions and contiguous with said contact surface, said counter surface being angularly oriented with respect to said contact surface and providing clearance between said hook and said other of said upper and lower receiver portions for rotation of said body disengaging said hook from said contact surface.

18. A firearm having an upper and a lower receiver portion joined to one another by a pivot bearing, said receiver portions being movable on said pivot bearing relatively to one another between an open and a closed configuration, a catch for releasably retaining said upper receiver portion to said lower receiver portion, said catch comprising:

a shaft rotatably mounted within said lower receiver portion;

a lever extending transversely from said shaft for manual rotation thereof, said lever overlying an outer surface of said lower receiver portion;

a body mounted on said shaft and rotatable therewith, said body being positioned within said lower receiver portion;

a hook positioned on said body;

a contact surface positioned on said upper receiver portion, said hook being engageable in positive mechanical engagement with said contact surface for retaining said upper and lower receiver portions to one another.

19. The firearm according to claim 18, further comprising:

a cam follower projecting from said body, said shaft being positioned between said cam follower and said hook;

a cam surface mounted on said upper receiver portion and positioned so as to engage said cam follower when said receiver portions are moved into said closed configuration so as to rotate said body such that said hook engages said contact surface and retains said upper receiver portion to said lower receiver portion.

20. The firearm according to claim 18, wherein said body and said shaft are separate parts from one another.

21. The firearm according to claim 20, wherein:

said body has a non-round opening extending therethrough;

said shaft has a non-round portion matched in shape to said non-round opening of said body, said non-round portion being received within said non-round opening.

22. The firearm according to claim 21, wherein said non-round portion of said shaft has a square cross section.

23. The firearm according to claim 18, further comprising a retaining nut receiving said shaft, said retaining nut being received within an opening in said lower receiver, said retaining nut having a shoulder projecting outwardly therefrom, said shoulder engaging an inner surface of said lower receiver portion.

24. The firearm according to claim 23, wherein:

said shaft comprises a threaded portion having external screw threads thereon;

said retaining nut has internal screw threads matched to said external screw threads of said shaft, said nut receiving said threaded portion of said shaft.

25. The firearm according to claim 18, wherein said shaft is positioned distally to said pivot bearing.

26. The firearm according to claim 18, wherein said contact surface is angularly oriented relative to a firing axis of said firearm.

27. The firearm according to claim 26, further comprising a counter surface on said upper receiver portion and contiguous with said contact surface, said counter surface being angularly oriented with respect to said contact surface and providing clearance between said hook and said upper receiver portion for rotation of said body disengaging said hook from said contact surface.

* * * * *